United States Patent [19]

Cordery

[11] Patent Number: 5,005,001

[45] Date of Patent: Apr. 2, 1991

[54] FIELD GENERATION AND RECEPTION SYSTEM FOR ELECTRONIC ARTICLE SURVEILLANCE

[75] Inventor: Robert A. Cordery, Danbury, Conn.

[73] Assignee: Pitney Bowes Inc., Stamford, Conn.

[21] Appl. No.: 505,079

[22] Filed: Apr. 5, 1990

[51] Int. Cl.[5] ..... G08B 13/24

[52] U.S. Cl. ..... 340/551; 340/572

[58] Field of Search ..... 340/572, 551, 825.72

[56] References Cited

U.S. PATENT DOCUMENTS

| | | | |
|---|---|---|---|
| 3,747,086 | 7/1973 | Peterson | 340/572 |
| 3,983,552 | 9/1976 | Bakeman, Jr. et al. | 340/572 |
| 4,139,844 | 2/1979 | Reeder | 340/572 |
| 4,710,752 | 12/1987 | Cordery | 340/551 |
| 4,872,018 | 10/1989 | Feltz et al. | 340/572 X |

*Primary Examiner*—Glen R. Swann, III
*Assistant Examiner*—Thomas J. Mullen, Jr.
*Attorney, Agent, or Firm*—Peter Vrahotes; Melvin J. Scolnick; David E. Pitchenik

[57] ABSTRACT

An electronic surveillance system includes a signal generator for generating a magnetic field, a signal receiver within the influence of the magnetic field, and a ferromagnetic marker adapted to pass in the field for detection. The signal received includes an arrangement for generating a non-rotating field at a first frequency, and a rotating field at a second frequency that is lower than the first frequency.

4 Claims, 3 Drawing Sheets

FIELD GENERATION AND RECEPTION SYSTEM FOR ELECTRONIC ARTICLE SURVEILLANCE

BACKGROUND OF THE INVENTION

This invention relates to electronic surveillance systems, and more in particular to an improved field generation and reception arrangement for use in such systems.

Electronic surveillance systems of the type to which the present invention is directed, are generally employed to detect the presence of a magnetic marker in a magnetic field. Such systems thus include a device for generating a magnetic field, and a receiver for detecting variations in the field resulting from passing of a marker, generally carried by an article, through the field.

Such a system is disclosed, for example, in U.S. Pat. No. 4,71C,752, Cordery. In the system disclosed in this reference, the ability of the system to detect the presence of a marker, in the presence of noise, is enhanced by forming the magnetic field of more than one frequency component. The ferromagnetic marker effects the modulation of the higher frequency component with the lower frequency component to produce output pulses at the frequency of the higher frequency field component and its harmonics that are modulated by the lower frequency component and its harmonics. The sidebands of the pulses output from the marker are readily distinguished from noise, to increase the ability of the system to distinguish the presence or absence of a marker in the field. Such a system thus enables detection of smaller tag signals and/or increased spacing between the signal generator and the receiver.

A further electronic surveillance system for generating a magnetic field and receiving signals therefrom is disclosed in U.S. Pat. No. 4,872,018. In this patent, the transmitter and receiver are each provided with an antenna having two pairs of twisted loops. The twists are provided in the transmitting antenna to confine the transmitted signal to an area close to the transmitter and reduce the amount of signal outside the immediate vicinity of the transmitting antenna.

In systems of the above type, a magnetic marker "switches", to provide a detectable "output", when the externally applied field passes the coercive field of the ferromagnetic marker. If the marker is biased, then the phase of the externally applied field at which the marker switches is changed.

Soft magnetic markers for electronic surveillance systems are disclosed, for example, in U.S. Pat. Nos. 3,631,442; 3,747,086; 3,665,449 and 3,983,552 and French Patent No. 763,681.

SUMMARY OF THE INVENTION

Briefly stated, the invention provides a system for detecting the presence of a ferromagnetic marker in an interrogation zone. The system includes first and second generating means for generating first and second magnetic fields, respectively, at first and second frequencies. The second frequency is substantially lower than the first frequency. The first generating means comprises means for generating an alternating field at the first frequency and the second generating means comprises means for generating a rotating field at the second frequency.

The first generating means may comprise an antenna having a single coil and means for applying oscillations at the first frequency to this coil. The second generating means comprises an antenna having at least first and second coils, and means applying oscillations at the second frequency to the first and second coils to generate magnetic fields that are shifted in phase with respect to one another. The first and second coils may each be comprised of a pair of coils twisted with respect to one another. The rotating field at the second frequency is produced by a phase shift between the oscillations in the first and second coils. The phase shift may be produced in the coils by passive impedances, but it can be produced by other means.

BRIEF DESCRIPTION OF THE DRAWING

In order that the invention may be more clearly understood, it will now be disclosed in greater detail with reference to the accompanying drawing, wherein.

DETAILED DISCLOSURE OF THE INVENTION

Figure 1:
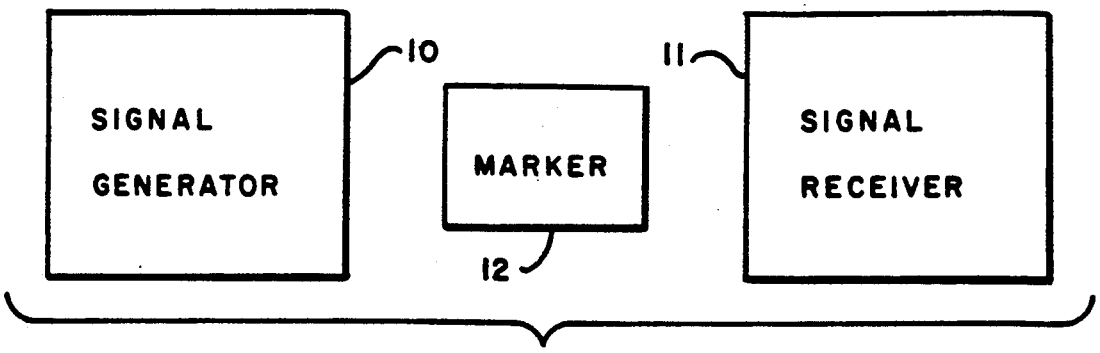
FIG. 1 is a block diagram of an electronic surveillance system of a type in which the marker of the invention may employed.

FIG. 1 is a simplified block diagram of an electronic surveillance system of the type that may employ the magnetic marker of the invention. In this system, a signal generator 10 and a signal receiver 11 are positioned such that a magnetic marker 12 may pass in a position to influence the field detected by the receiver. The signal generator 10 may be comprised, for example, of a loop antenna coupled to a source of alternating energy and optionally shielded in order to remove the electrostatic field.

The signal receiver 11 may also be comprised of an optionally shielded loop antenna, and this antenna may be connected to, for example, a signal detector tuned to the sidebands of one or several of the harmonics of the first frequency.

The marker 12 may be formed of a ferromagnetic material, and may be incorporated in or affixed to an article whose passage through the magnetic field is to be detected.

Figure 2:
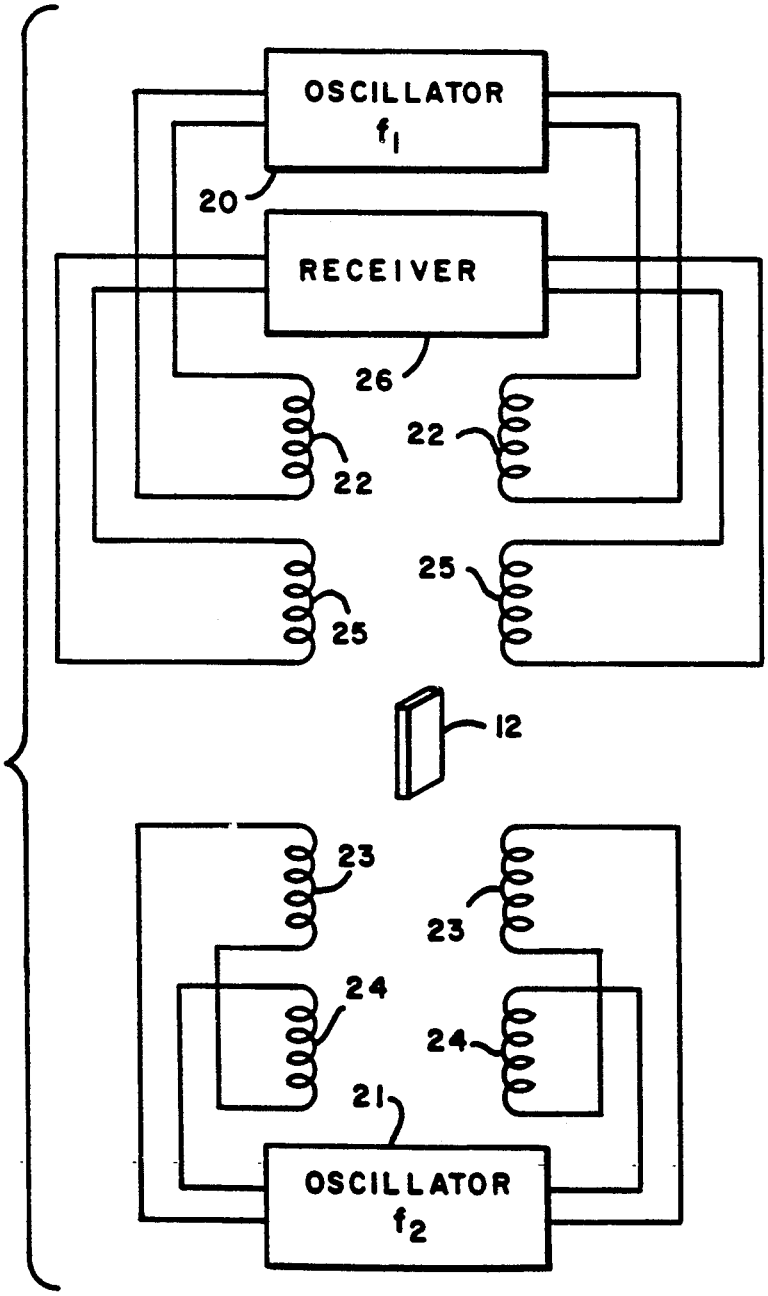
FIG. 2 is a simplified block diagram of a system in accordance with the invention.

In accordance with one embodiment of the invention, as illustrated in FIG. 2, a signal generator is comprised of a first oscillator 20 generating oscillations of a first frequency $f_1$ and a second oscillator 21 generating oscillations of a second frequency $f_2$.

The first oscillator 20 is connected to apply energy to a first antenna 22, which may consist of a single untwisted coil on each side of the passage, so that the magnetic field generated by this antenna is not rotating. The loop may be electrostatically shielded.

The second oscillator 21 is connected to apply energy to an antenna to provide a rotating field. For example, this antenna may be comprised of separate pairs of coils 23, 24 on each side of the passage. Since the low frequency coils must have very low mutual inductance with the high frequency transmitter coils in view of the large voltage that would be otherwise induced therein, the low frequency coils 23, 24 on each side of the passage may be twisted with respect to one another, to provide fields that are shifted by 180 degrees.

The first oscillator 20 may provide a fixed frequency output, for example in the range of 5 to 10 kHz, with an output for generating a field having an amplitude that might not be greater than 3 Oe in the middle of the gate. The second oscillator may provide an output in the range of 100 to 1000 Hz, with an output for generating a field having an amplitude of about 0.5 Oe. It is of course apparent that the invention is not limited to this range of frequencies and magnetic intensities.

Figure 3A:
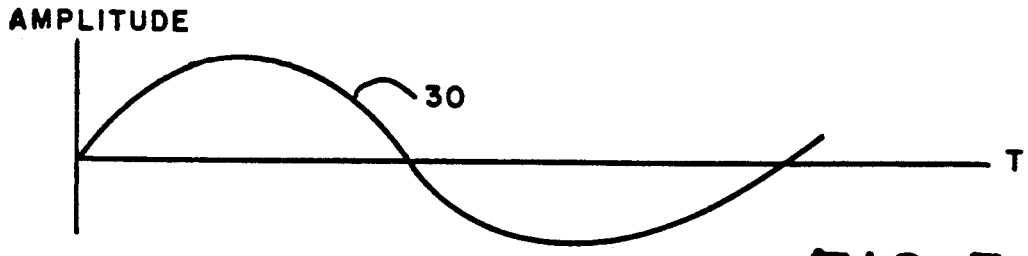
FIG. 3*a* is a time diagram illustrating the high frequency magnetic field.
Figure 3B:
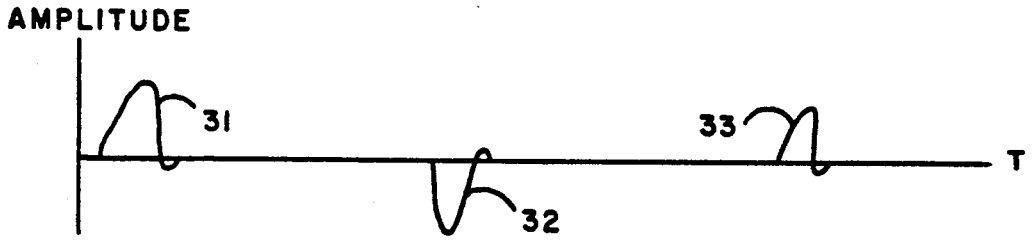
FIG. 3*b* is a time diagram illustrating the voltage pulses induced by the tag in response to the magnetic field of FIG.3*a;*

As illustrated in FIG. 3*a*, curve 30 represents the higher frequency magnetic field produced by the oscillator 20. The reference numerals 31, 32 and 33 in FIG. 3*b* represent the pulses output by the ferromagnetic marker 12 in response to this field. These pulses occur at times at which the external field passes the coercive field of the marker. The pulses generated by the marker are detected by the receiver, which may comprise a loop antenna 25 coupled to apply its received energy to a detector 26, as illustrated in FIG. 2.

Figure 4A:
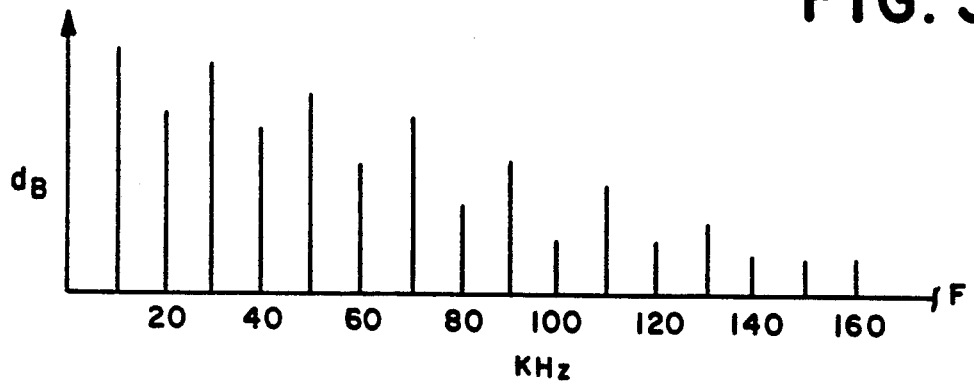
FIGS. 4*a*–4*c* are frequency graphs illustrating the frequency components in the signals, for explaining the operation of the invention.
Figure 4B:
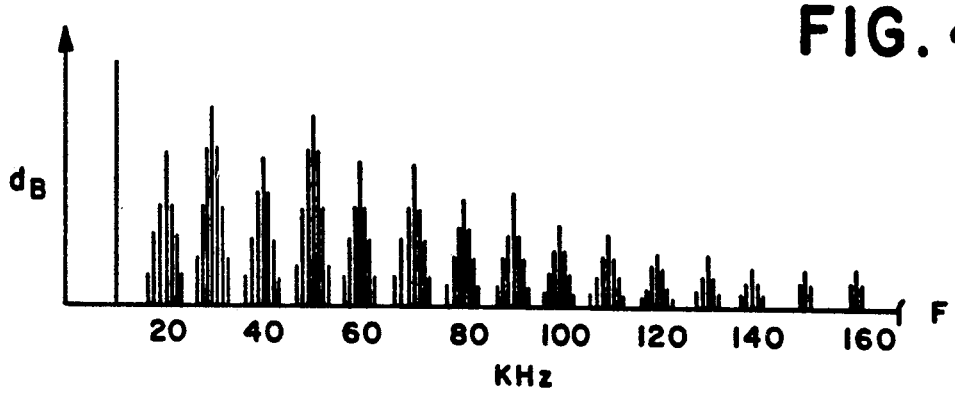
Figure 4C:
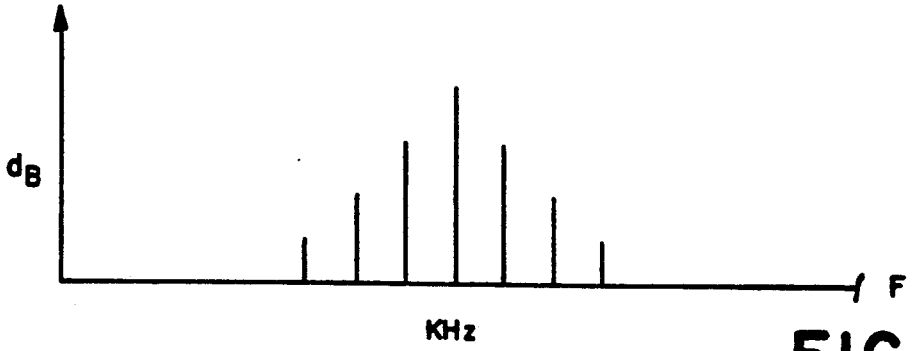

FIG. 4*a* illustrates the distribution of frequencies in the field as received by the detector, when a fixed field of 10 kHz is generated by the signal generator, in the absence of the lower frequency field, and a ferromagnetic marker is in the field. As discussed in the above noted U.S. Pat. No. 4,710,752, these signals, while possibly detectable, are not significantly different from noise. When the lower frequency field is also present, however, the ferromagnetic marker modulates the higher frequency field with the lower frequency field, to produce a frequency distribution, for example as illustrated in FIG. 4*b*. Each harmonic of the higher frequency field, one of which is illustrated in FIG. 4*c*, hence has upper and lower side bands to render the introduction of the marker in the field much easier to detect.

In accordance with the invention, the main field i.e. the higher frequency field generated by the oscillator 20, is not rotated since rotation of this field renders the time of the signal indeterminate. The lower frequency field is rotated, however, in order to avoid blind spots in the field that may render detection of the marker difficult.

Figure 5:
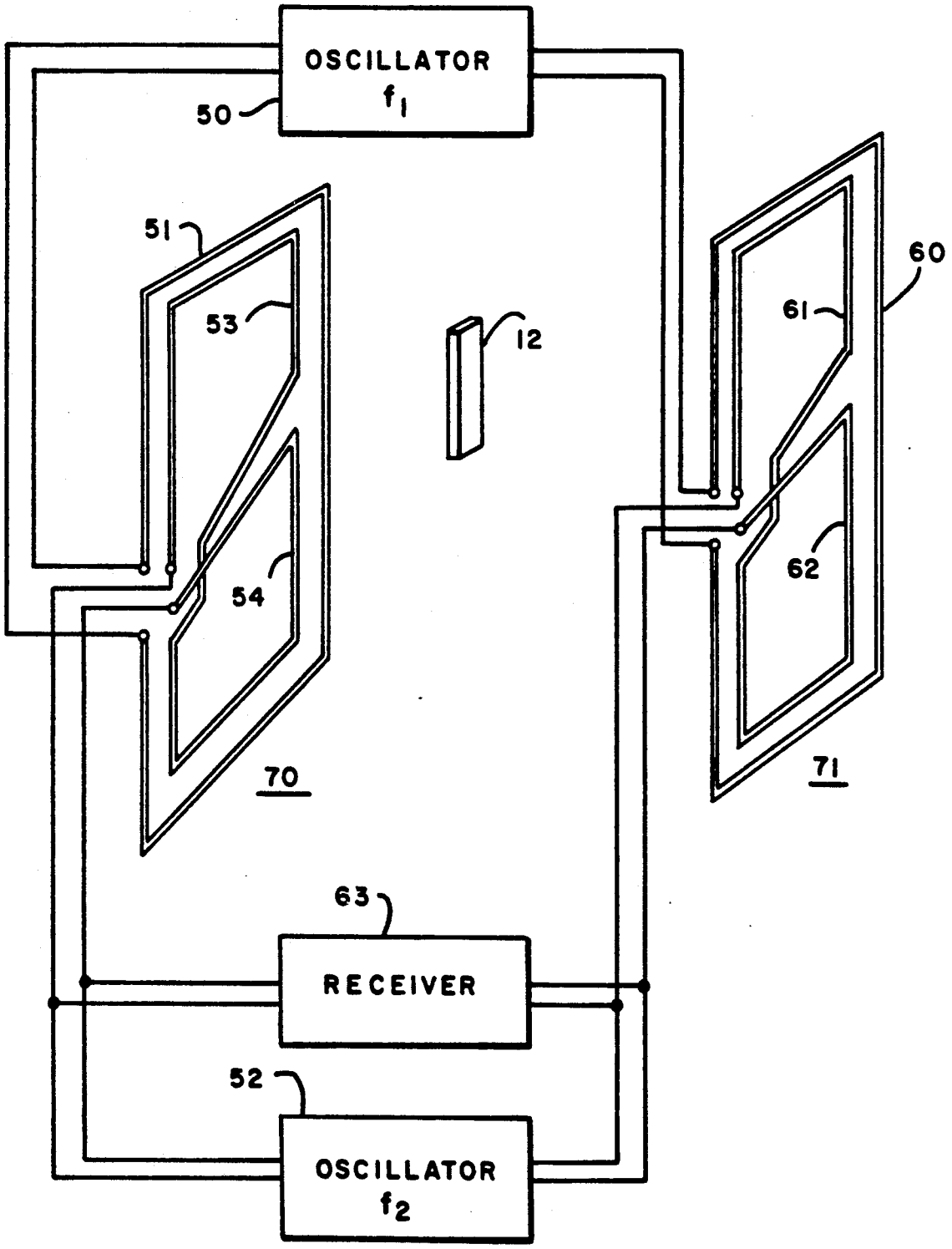
FIG. 5 is a simplified illustration of antennas employed in accordance with one embodiment of the invention.

One embodiment of a system in accordance with the invention is illustrated in FIG. 5, wherein an oscillator 50 is coupled to apply energy to an untwisted shielded coil 51, 60 of the two gates 70, 71, for the generation of a non-rotating magnetic field. The oscillation frequency of the oscillator 50 is fixed, for example between 2 and 10 kHz.

The low frequency oscillator 52, which may provide an output from about 100 to 1000 Hz, is coupled to apply energy to the two twisted coils 53, 54, and 61, 62 which may be shielded, although they are not necessarily shielded. The 180° twist between loops 53 and 54, and the 180° twist between coils 61 and 62, provide low mutual inductance with the generating coils 51 and 60. A phase shift between the oscillators applied to the coils 53, 54 and 61, 62 of the two gates 70, 71, to provide the rotating field, may be provided either by a passive circuit in the oscillator 52, or by driving the coils with separate amplifiers. It is preferred that the coils of each gate be located in a common plane.

The signal receivers of the two gates may be coupled to detect voltages in the two coil pairs 53, 54 and 61, 62, or separate receiving coil antennas may be provided and configured in the same manner as the transmitting antennas, e.g. with a twisted pair of inner coils connected to the receiver 63. The receiving circuits may be of the type disclosed in U.S. Pat. No. 4,710,752.

It is of course apparent that other forms of coil antenna structures may alternatively employed.

While the invention has been disclosed an described with reference to a single embodiment, it will be apparent that variations and modification may be made therein, and it is therefore intended in the following claims to cover each such variation and modification as falls within the true spirit and scope of the invention.

What is claimed is:

1. In a system for detecting the presence of a ferromagnetic marker in an interrogation zone, including first and second generating means for generating first and second magnetic fields, respectively, at first and second frequencies, respectively, and wherein said second frequency is substantially lower than said first frequency, the improvement wherein said first generating means comprises means for generating an alternating field at said first frequency and said second generating means comprises means for generating a rotating field at said second frequency.

2. The system of claim 1 wherein said first generating means comprises an antenna having a single coil, and means for applying oscillations at said first frequency to said single coil, and said second generating means comprises an antenna having at least first and second coils, and means applying oscillations at said second frequency to said first and second coils to generate magnetic fields that are shifted in phase with respect to one another.

3. The system of claim 2 wherein said first and second coils each comprise a pair of coils that are twisted with respect to one another.

4. The system of claim 2 wherein said single coil comprises a coil section in a common plane with said first coil and a coil section in a common plane with said second coil.

* * * * *